United States Patent [19]

Berezkina et al.

[11] Patent Number: 4,786,184

[45] Date of Patent: Nov. 22, 1988

[54] APPARATUS FOR MIXING HETEROGENEOUS SUBSTANCES

[75] Inventors: Nina G. Berezkina, Tulskaya; Jury V. Martynov, Moscow; Boris I. Lurie, Tulskaya; Nikolai N. Torubarov, Moscow; Jury N. Chupin, Moscow; Vladimir P. Shevchenko, Moscow; Jury. S. Ryazantsev, Moscow; Vladimir A. Ivanov, Moscow; Igor N. Karasev, Moscow; Nikolai S. Tsaplin, Moscow; Zhan A. Golovanov, Balashikha Moskovskoi; Alexei N. Rudakov, deceased, late of Moscow, all of U.S.S.R., by Elena A. Rudakova, administrator

[73] Assignee: Institut Problem Mekhainiki, Moscow, U.S.S.R.

[21] Appl. No.: 10,743

[22] Filed: Feb. 4, 1987

[51] Int. Cl.[4] ..... B01F 9/22

[52] U.S. Cl. ..... 366/288

[58] Field of Search ..... 366/287, 288, 297, 298, 366/300; 99/348

[56] References Cited

U.S. PATENT DOCUMENTS

| | | | |
|---|---|---|---|
| 2,209,287 | 7/1940 | Simpson | 366/281 |
| 3,075,746 | 1/1963 | Yablonski | 366/288 |
| 3,224,744 | 12/1965 | Broomall | 366/288 |
| 4,337,000 | 6/1982 | Lehmann | 366/288 |
| 4,380,398 | 4/1983 | Burgess | 366/288 |

*Primary Examiner*—Robert W. Jenkins

*Attorney, Agent, or Firm*—Lilling & Greenspan

[57] ABSTRACT

An apparatus for mixing heterogeneous substances comprises a casing with phase inlet and outlet unions, and a container. Accommodated in the container are at least two agitator-carrying shafts connected with a drive. The drive has a driving shaft with a carrier rigidly secured thereon, a second carrier, at least two satellites meshing with a central gear wheel. Each of the satellites is provided with at least one crank movably connected with a pitman, said crank and pitman connecting each satellite with one of said carriers.

8 Claims, 3 Drawing Sheets

APPARATUS FOR MIXING HETEROGENEOUS SUBSTANCES

BACKGROUND OF THE INVENTION

FIELD OF THE INVENTION

The present invention relates to mechanical mixing apparatus and, more particularly, to an apparatus for mixing heterogeneous substances (or materials).

The herein-proposed apparatus will be of use in chemical industry, for example in production of mineral fertilizers, in food industry for conching of chocolade, in microbiological industry for production of fodder yeast and enzyme preparations, in petrochemical, medical and other industries.

DESCRIPTION OF THE PRIOR ART

Known in the prior art is an apparatus for mixing heterogeneous substances (Cocoa, chocolade, praline. Ed. by G. P. Ermakova, Moscow, "Food Industry", 1966, p. 304).

This apparatus comprises a casing with phase inlet and outlet unions and has a container with three agitator-carrying shafts arranged around the periphery of said container and connected with a drive.

The drive comprises a driving shaft with a carrier which is movably linked with the satellite shafts rigidly mounted on which are said agitator-carrying shafts. The satellites are in mesh with an immovable gear wheel.

In this apparatus three agitators rotate at a constant angular velocity around their longitudinal axes and at a constant angular velocity around the casing longitudinal axis.

The agitators rotating at a constant angular velocity fail to create highly turbulent flows of fluid so that the velocity rate of the mass exchange processes will be rather low which reduces the specific output of the apparatus and steps up electric energy consumption.

Another known mixing apparatus (U.S. Pat. No. 2209287, Cl.259-105, 1938) comprises a casing with phase inlet and outlet unions and a container in which two coaxial agitator-carrying shafts are installed along the axis thereof and linked with a drive mounted on the casing.

The drive comprises a driving shaft connected rigidly with said internal agitator-carrying shaft and rotating it at a constant angular velocity. The drive also comprises an external gear wheel whose shaft carries said external agitator-carrying shaft and an internal gear wheel connected by an L-shaped carrier with the driving shaft. Both gear wheels are in mesh with the pinions and rotate an external agitator-carrying shaft at a constant angular velocity.

The agitators rotate in contrary directions at constant angular velocities of different magnitude.

Rotation of the agitators at a constant velocity fails to provide highly-turbulent flows which diminishes the specific output of the apparatus. Besides, the flow is divided in the apparatus into two circulating streams with an insignificant mass exchange between them which results in different reaction outputs in these zones and increases the mixing time.

One more known apparatus for mixing heterogeneous substances (The USSR Inventor's Certificate No. 829154, Cl.BO 1F 7/18, 1981) comprises a casing with phase inlet and outlet unions, a container accommodating a shaft with an agitator, said shaft being connected with a tooth-and-lever drive installed on the casing. The drive comprises a driving shaft arranged along the longitudinal axis of the casing and carrying a rigidly mounted carrier arranged coaxially with said shaft and movably connected with the satellite shaft, whereas the satellite has a crank linked with a pitman which is kinematically connected with a second carrier.

The second carrier is rigidly mounted on the agitator-carrying shaft and the drive shaft is connected with the motor shaft. The satellite meshes with a fixed central gear wheel.

The motion is transmitted from the driving shaft to a first carrier which, rotating about its axis, transmits motion to the satellite and, via a crank installed eccentrically on it, to a pitman and a second carrier. Inasmuch as the crank is installed eccentrically on the satellite which meshes with a fixed gear wheel, the angular velocity of the agitator-carrying shaft connected with the second carrier becomes unstable in time which builds up a highly turbulent flow in the apparatus. However, such a drive enables only one agitator-carrying shaft to be installed in the apparatus which denies the possibility of handling large amounts of mixed materials and accelerating the mass-exchange processes in heterogeneous substances. Employment of an apparatus with large agitating elements is inexpedient due to a sharp increase in the consumed power.

Besides, this apparatus is noted for a large proportion of stagnant and low-effective zones.

It is an object of the present invention to provide an apparatus for mixing heterogeneous substances which improves the quality of the end product along with a reduction of power consumption.

SUMMARY OF THE INVENTION

The object is achieved by providing an apparatus for mixing heterogeneous substances comprising a casing with phase inlet and outlet unions, a container accommodating a shaft with an agitator, said shaft being connected with a drive in the form of a tooth-and-lever mechanism installed on said casing and having a driving shaft with a rigidly mounted coaxial carrier installed along the longitudinal axis of the casing, and a second carrier, each of said carriers being movably linked with a satellite arranged parallel to the driving shaft and meshing with the central gear wheel in which, according to the invention, there is provided at least one more agitator-carrying shaft and in which said drive has at least one more satellite meshing with said central gear wheel, said satellites are installed with a specified clearance and are provided with at least one crank movably connected with a pitman, said crank and pitman connecting each satellite with one of said carriers.

This improvement of the drive design permits the apparatus to be provided with several agitator-carrying shafts, rotating with intracycle changes of angular velocity which provides for creating highly-turbulent flow in the heterogeneous substances, thereby accelerating considerably the progress of heat-and-mass exchange processes and eliminating the stagnant and low-effective zones. The apparatus is capable of handling large amounts of mixed substances at a moderate power expenditure.

It is suggested that each satellite in the drive be linked by a crank and a pitman with the second carrier and the shaft of each satellite be movably connected with the first carrier or, alternatively, each satellite be connected by a crank and a pitman with the first carrier and their shafts, jointly with the agitator-carrying shafts rigidly mounted on them be movably connected with the second carrier.

This design of the drive ensures a circular motion of the agitators with intracycle changes of angular velocity thus intensifying substantially the process of mixing.

It is practicable for more uniform mixing of heterogeneous substance to install radially around the entire periphery of the casing container three shafts with agitators by appropriate orienting of the satellite shafts relative to the driving shaft.

To create in the meridional plane of the apparatus container the circulating flows sweeping the entire volume of the heterogeneous substance being mixed and equalizing the concentration in its volume it is desirable that the apparatus be provided with two agitator-carrying shafts, one of them being secured on the driving shaft while the other one is arranged coaxially to the driving shaft and rigidly mounted on the second carrier.

It is practicable that the drive should have two satellites with two cranks on each of them, the cranks being made with different radii forming an angle of 45°–180°, and should have one more second carrier, the connection between each satellite and each second carrier being ensured by said pair of cranks movably linked with the pitmans, and the driving shaft and second carriers should have rigidly mounted agitator-carrying shafts.

This design of the apparatus is conductive to intensifying the mixing process and improving the quality of the end product by intracycle changes of amplitude and frequency of the angular velocity of agitators and by periodical changes in the direction of their rotation which ensures the development of turbulent flows and an increase in the meridional circulation of the heterogeneous substance being mixed in the container.

It is recommended that the drive be provided with two gear quadrants meshed with pinions, rigidly secured on the second carrier and located on either side of the driving shaft, that one of the gear quadrants be in external mesh with one of said pinions and the other one, in internal mesh with the other one of said pinions, and that the pinion shafts be connected by a screw-and-nut drive with the agitator-carrying shafts.

By imparting reversible and reciprocating motion with intracycle changes of angular and vertical linear velocities to the agitators, it is possible to create well-developed turbulent flows inside the volume being mixed. Turbulization steps up the intensity of the mixing process.

It is desirable that the shafts of said pinions in the apparatus be oriented relative to the driving shaft so that the agitator-carrying shafts be arranged radially around the periphery of the casing container.

This arrangement of the agitators intensifies the mass-exchange processes due to a complex interaction of the flows between the central and peripheral agitators.

DESCRIPTION OF THE PREFERRED EMBODIMENT

Now the invention will be described in detail by way of example with reference to the accompanying drawings in which, according to the invention:

Figure 1:
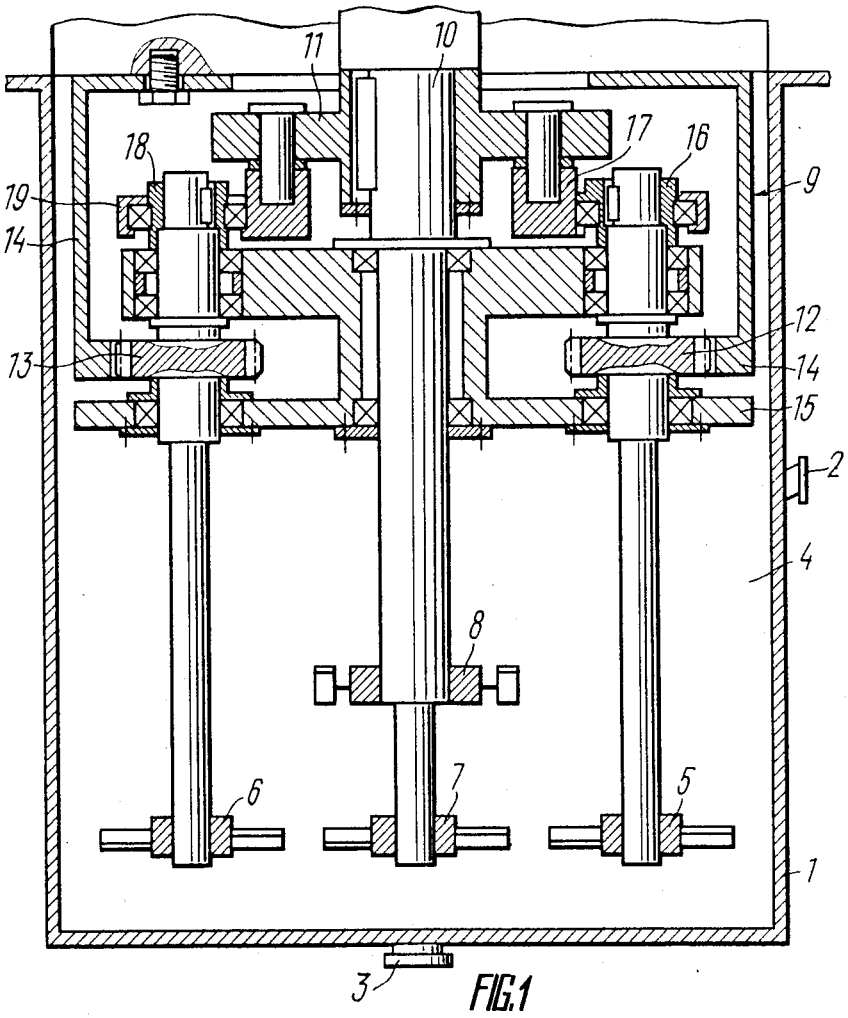
FIG. 1 is a schematic view of the apparatus for mixing heterogeneous substances with four agitators, longitudinal section.

The apparatus for mixing heterogeneous substances (FIG. 1) comprises a casing 1 with phase inlet and outlet unions 2, 3 and accommodates a container 4. The container 4 has agitator-carrying shafts 5, 6, 7, 8 connected with a drive 9 in the form of a tooth-and-lever mechanism installed on the casing 1. The drive 9 has a driving shaft 10 with a rigidly secured and coaxially arranged carrier 11, said shaft being installed along the longitudinal axis of the casing 1. Arranged parallel to the driving shaft 10 are the shafts of two satellites 12, 13 installed with a specified clearance, meshing with the central gear wheel 14 and their shafts are connected movably with the second carrier 15. Secured rigidly on the shafts of satellites 12, 13 are agitator-carrying shafts 5, 6. The satellite shafts are oriented relative to the driving shaft so that the shafts 5, 6 are installed in the container 4 of the casing 1 radially around the entire periphery. The agitator-carrying shaft 7 is fastened on the driving shaft 10. Installed coaxially to the driving shaft 10 is the agitator-carrying shaft 8 secured on the second carrier 15. The satellite 12 has a crank 16 movably connected with the pitman 17 while the satellite 13 has a crank 18 movably connected with the pitman 19. The satellites 12, 13 are connected by these kinematic pairs with the first carrier 11. The number of the satellites and the corresponding agitator-carrying shafts depends on the volume of mixed heterogeneous substances, their structure, velocity of chemical reactions and heat-and-mass exchange processes.

Figure 2:
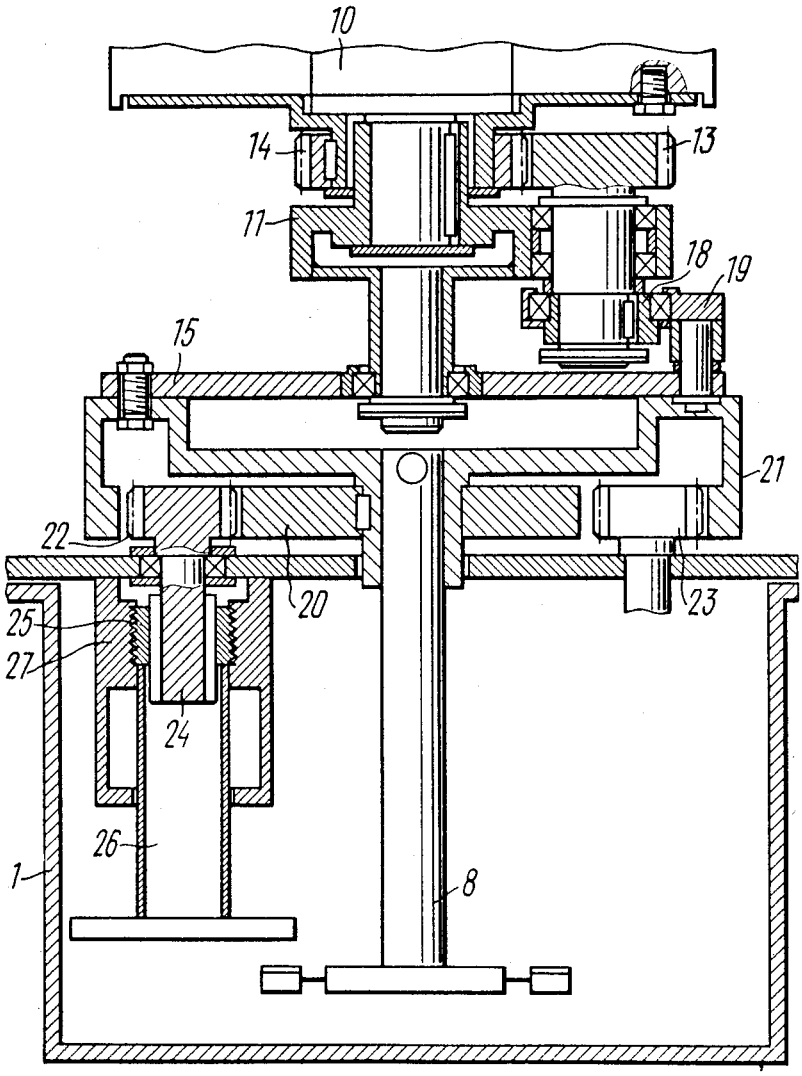
FIG. 2 is another version of the claimed apparatus, longitudinal section.

A considerable increase in the velocity of heat-and-mass exchange processes can be achieved with a minimum number of satellites in the drive and a maximum number of shafts with agitators. We herein propose one more version of connecting the satellites with carriers and fastening the agitator-carrying shafts (FIG. 2).

The arrangement in the drive of the remaining satellites and their linking with the carriers are similar to those described below and are not shown in FIG. 2 for simplifying the drawing. The satellite 13 is connected with the second carrier 15 by the crank 18 and the pitman 19. The shaft of the satellite 13 is movably connected with the first carrier 11. The satellite 13 meshes with the fixed central gear wheel 14. In this case agitator-carrying shafts can be secured on the second carrier (not shown in Fig.2). However, with a view to removing a mixed heterogeneous substance from the free surface and intensifying the mass exchange processes it is expedient that, in addition to reversible motion, the agitator-carrying shafts be imparted reciprocating motion too.

For this purpose the second carrier 15 is rigidly connected with two gear quadrants 20, 21 located on either side of the driving shaft 10. The quadrant 20 is in external mesh with the pinion 22 while the quadrant 21, in internal mesh with the pinion 23. The shaft 24 of the pinion 22 is connected by a screw-and-nut drive 24, 25 with the agitator-carrying shaft 26.

The connection of the pinion 22 with the agitator-carrying shaft is not shown in the drawing.

The nut 25 of the screw-and-nut pair with external thread is accommodated in the sleeve 27 which is threaded on the internal surface. The shaft of the pinion 22 serves as the leading screw of said pair. The nut 25 is rigidly connected with the agitator-carrying shaft 26. The agitator-carrying shaft 8 is rigidly mounted on the carrier 15.

Figure 3:
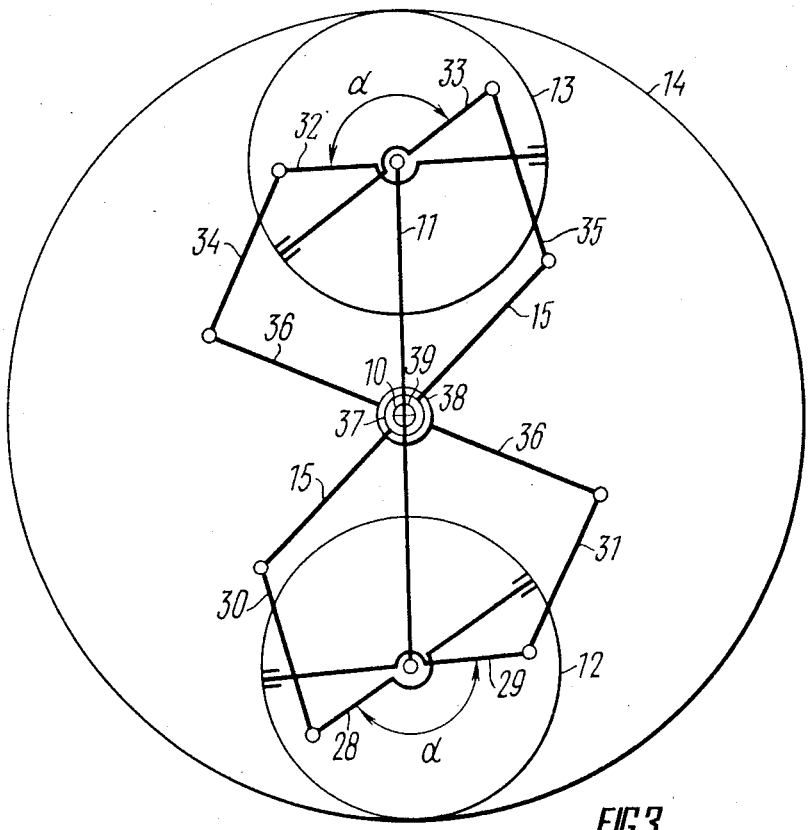
FIG. 3 is a kinematic diagram of the drive mechanism in the apparatus with three coaxial agitator-carrying shafts.

We herein propose still another embodiment of connection between satellites and carriers and of fastening the agitator-carrying shafts (Fig.3, kinematic diagram). The shafts of the satellites 12, 13 are movably connected with the carrier 11 and mesh with the fixed central gear wheel 14. The satellite 12 is provided with a pair of cranks 28, 29 movably linked with the pitmans 30, 31 while the satellite 13 has a pair of cranks 32, 33 movably connected with the pitmans 34, 35. The cranks 28, 29, 32, 33 are made with different radii, each pair of which forms an angle of 45°–180°. The drive 9 comprises two second carriers 15, 36. The satellite 12 is linked with the carrier 15 by a kinematic pair crank 29 - pitman 30 and with the carrier 36, by a kinematic pair crank 29 - pitman 31. The satellite 13 is connected with the carrier 15 by a kinematic pair crank 33 - pitman 35 and with the carrier 36, by a kinematic pair crank 32 - pitman 34. The pitmans 30, 31, 34, 36 are movably connected with the second carriers 15, 36. Mounted rigidly and coaxially on the second carriers 15, 36 are agitator-carrying shafts 37, 38, the agitator-carrying shaft 39 being installed coaxially with the shafts 37, 38 and connected rigidly with the driving shaft 10. With the agitator-carrying shafts 37, 38 secured on different carriers 15, 36 driven by one satellite 12 or 13 the maximums of agitator angular velocities become displaced in time relative to one another. It means that the irregularity cycle of agitator angular velocities will be shifted in phase. This will ensure a constantly changing turbulization and circulation of the flows in the volume of mixed heterogeneous substances thereby intensifying considerably the process of mixing.

The apparatus for mixing heterogeneous substances functions as follows.

The container 4 of the casing 1 is filled with a heterogeneous substance through the phase inlet union 2. Rotation is transmitted from the motor to the driving shaft 10 and thence to the carrier 11 which, rotating around its axis, transmits motion to the pitmans 17, 19 and to the toothed satellites 12, 13 via cranks 16, 18 linked kinematically with said satellites 12, 13, respectively, and to the second carrier 15 which are movably connected with the shafts of the satellites 12, 13. Owing to the fact that the cranks 16, 18 are eccentrically installed on the satellites 12, 13 meshing with the immovable gear wheel 14, the angular speed and acceleration of the second carrier 15 become unstable in time. Rotation of the satellites 12, 13 around their axes also becomes unstable in time. The motion with intracycle changes of amplitude and frequency of the angular speed of the satellites 12, 13 is transmitted to the agitator-carrying shafts 5, 6. The mixed heterogeneous substance is discharged through the phase outlet union 3.

Thus, a circular motion of the agitators is created in the apparatus, the agitators moving over a circle with intracycle continuous changes of the angular velocity which creates an additional turbulization with predominant large-scale pulsations of velocity and accelerates equalization of concentrations throughout the volume. Besides, moving around a circle, the agitators periodically come to each point of the flow. The agitators rotate around their axis also with continuously changing intracycle angular velocity which makes the flow still more turbulent. Besides, there appears a zone around the agitators where the jets flowing from under the agitators collide thus making the flow turbulent. All these factors increase considerably the velocity of mass exchange.

The agitator-carrying shaft 7 is set in motion by the driving shaft and the agitator moves at a constant angular velocity. The agitator-carrying shaft 8 is set in motion by the second carrier 15 so that the agitator rotates with intracycle changes of the angular velocity.

Thus, a complex motion of the fluid in the apparatus is caused by the interaction of hydrodynamic flows caused by the peripheral agitators rotating around their axes and over a circle, with the flows created by the central agitators. It becomes possible in the herein-disclosed apparatus to reduce the power required for the process since a higher mixing efficiency can be attained by agitators of a smaller diameter while the power required for the mixing process is proportional to the agitator diameter to the power of 5.

The coaxial arrangement of two shafts with agitators (the lower agitator is of the propeller type while the upper one belongs to a paddle or turbine-type variety) creates a double-circuit flow in the axial plane. The solid particles suspended in the fluid pass consecutively through the zones of operation of central and peripheral agitators and, inasmuch as the velocities of said agitators are different, this will create an additional difference of velocities of the solid particle and the fluid thus bringing about an intensification of mass exchange. Thus, a solid particle moving in a flow formed by the peripheral agitators passes into the flow of the lower central agitator whose rotation speed differs from that of the peripheral agitators and then gets into the zone of action of the upper agitator whose rotation speed also differs from that of the lower agitator. Then the particle again moves into the zone of action of the peripheral agitator.

In the apparatus with a high degree of turbulization of flows the electric motor transmits rotation to the driving shaft 10 on which the carrier 11 is mounted. Rotating, the carrier 11 sets the satellite 13 in rotation around the longitudinal axis of the casing; meshing with the fixed central gear wheel 14, the satellite 13 starts simultaneously to rotate around its own axis. The satellite 13 transmits motion on a hypotrochoid trajectory at a speed with intracycle changes to the crank 18 installed eccentrically on said satellite 13. The crank 18 acting via the pitman 19 transmits the intracycle changes of motion in one direction to the carrier 15 which drives the agitator-carrying shaft 8 secured on it. The motion is transmitted from the carrier 15 to the gear quadrants 20, 21 which set in rotation the pinions 22, 23 meshing with said quadrants 20, 21. The shaft of the gear 20 serving simultaneously as the screw in the screw-and-nut drive transmits reciprocating motion and irregular reversible rotation to the agitator-carrying shaft 26 via the nut 25 which is in engagement with the sleeve 27.

Due to the external meshing of the gear quadrant 20 with the pinion 22, the agitator-carrying shaft 26 rotates in the direction of movement of the crank 18. The pinion 23 meshing internally with the gear quadrant 21 transmits a reciprocating motion and irregular reversible rotation in the contrary direction at a lower speed to the agitator-carrying shaft (not shown in FIG. 2) via the screw-and-nut drive. The other satellites 13 and their kinematic linkage with the carriers 11, 15 are not shown in FIG. 2.

Thus, the central agitator rotates in one direction with continuous changes of angular velocity. The peripheral agitators execute reversible rotation and reciprocating motion with intracycle changes of angular and vertical linear velocities of different magnitude, creating a constantly changing turbulization and circulation of the flows inside the apparatus.

The intensity of mass exchange between the phases in the mixed substance grows radically due to creation of a substantial difference between the velocities of the solid and liquid particles in the volume being mixed.

The disclosed apparatus whose drive comprises satellites, each provided with several cranks, functions as follows.

Being started, the electric motor transmits uniform rotary motion to the driving shaft 10 and to the carrier 11 secured thereto. The carrier 11 sets in motion the satellites 12, 13 around the longitudinal axis of the casing 1. Simultaneously, the satellites 12, 13 rotate around their axes due to meshing with the fixed central gear wheel 14. Motion is transmitted from the satellites 12, 13 to the cranks 29, 32 which are kinematically linked with the pitmans 31, 34. The pitmans 31, 34 transmit rotary motion with intracyclically changing angular velocity to the second carrier 36 rigidly connected to the agitator-carrying shaft 38. The satellites 12, 13 also carry the cranks 28, 33 with radii differing from the radii of the cranks 29, 32, the angle formed by the cranks 28, 29 (32, 33) ranging from 45° to 180°. The motion from the cranks 28, 33 is transmitted by the cranks 30, 35 to the carrier 15 and the agitator-carrying shafts 37 rigidly connected thereto. The agitator-carrying shafts 37, 38 rotate with intracycle changes of angular velocities whose maximums are displaced in phase from each other due to the angles $\alpha$ formed by the pair of cranks on each of the satellites 12, 13. The difference in the radii of the cranks 32, 33 (28, 29) results in different maximums of angular velocities of the agitator-carrying shafts 37, 38. Uniform rotation is transmitted from the driving shaft 10 to the agitator-carrying shaft 39.

Due to coaxial arrangement of the shafts 36, 37, 38 with propeller-type agitators, a circulating motion of the heterogeneous substance arises in the cross sectional plane so that the entire volume of said substance passes in succession through the zone of action of all agitators. The solid particles periodically pass through the zones of action of the agitators on the shafts 37, 38, 39 rotating at different instantaneous velocities. This brings about a sharp increase in the relative velocities of the solid particles which increase the speed of heat-and-mass exchange processes.

The agitators in the disclosed apparatus move with intracycle changes of amplitude and frequency of the angular velocity at which the power effect of the paddle on the mixed substance is constantly changing so that the forces of inertia arising in the mixed volume are utilized more effectively.

When the rotation frequency of agitators is constantly changing within the cycle, there appear inertia forces due to which the solid particles of the mixed substance (or material), featuring a higher inertia than liquid, lag behind the liquid when the agitator rotation speed rises and, conversely, get ahead of the liquid when the rotation speed decreases. An increase in the relative velocities of the phases brings about a substantial intensification of the bear-and-mass exchange processes, and uniform distribution of phases within the volume of the substance. Besides, intracycle changes of the amplitude and frequency of the angular velocity of the agitator result in a higher energy of turbulent pulsations and eliminate a funnel on the surface of the liquid.

What is claimed is:

1. An apparatus for mixing heterogeneous substances comprising:

a casing;

phase inlet and outlet unions mounted on said casing;

a container accommodated in said casing;

at least two shafts carrying agitators, located in said container;

a drive installed on said casing and comprising a driving shaft arranged along the longitudinal axis of said casing, a first carrier rigidly connected with said driving shaft, coaxially thereto; at least one second carrier; a central gear wheel; at least two satellites installed with a specified clearance parallel to the driving shaft and meshing with the central gear wheel; at least one crank located on each of said satellites; pitmans connected movably with said cranks, the connection between each of said satellites and one of said carriers being ensured by the crank movably linked with the pitman; said shafts with agitators are connected with said drive.

2. An apparatus as claimed in claim 1 wherein each satellite in the drive is connected by the crank and pitman with said first carrier while their shafts jointly with the agitator-carrying shafts rigidly fastened thereon are movably connected with the second carrier.

3. An apparatus as claimed in claim 2 wherein, in case of three agitator-carrying shafts, the satellite shafts are so oriented relative to the driving shaft that the agitator-carrying shafts are arranged in the casing container radially around the entire periphery.

4. An apparatus as claimed in claim 3 wherein there are provided two more agitator-carrying shafts, one secured on the driving shaft, whereas the other is installed coaxially to the driving shaft and is rigidly secured on the second carrier.

5. An apparatus as claimed in claim 1 wherein each of the satellites in the drive is connected by the crank and pitman with the second carrier, the shaft of each of them being connected movably with the first carrier.

6. An apparatus as claimed in claim 5 wherein, if the drive comprises two second carriers rigidly connected with the agitator-carrying shafts, two satellites and two cranks on each of them, the cranks are made with different radii forming an angle of 45° to 180° and the connection between each satellite and each one of the second carriers is accomplished by said pair of cranks movably connected with the pitmans.

7. An apparatus as claimed in claim 5 wherein the drive comprises two gear quadrants linked with the pinions, rigidly secured on the second carrier and located on either side of the driving shaft, one of the gear quadrants meshes externally with one of said pinions while the other one meshes internally with the other one of said pinions, the pinion shafts being connected by a screw-and-nut drive with the agitator-carrying shafts.

8. An apparatus as claimed in claim 7 wherein the shafts of said pinions are so oriented relative to the driving shaft that the agitator-carrying shafts are arranged radially around the periphery of the casing container.

* * * * *